US011161714B2

(12) United States Patent
Mahoney et al.

(10) Patent No.: US 11,161,714 B2
(45) Date of Patent: Nov. 2, 2021

(54) LANDING IDENTIFICATION SYSTEM TO DETERMINE A BUILDING LANDING REFERENCE FOR AN ELEVATOR

(71) Applicant: Otis Elevator Company, Farmington, CT (US)

(72) Inventors: Sally Day Mahoney, New Hartford, CT (US); Michael C. Schiappa, Burlington, CT (US)

(73) Assignee: Otis Elevator Company, Farmington, CT (US)

( * ) Notice: Subject to any disclaimer, the term of this patent is extended or adjusted under 35 U.S.C. 154(b) by 796 days.

(21) Appl. No.: 15/910,470

(22) Filed: Mar. 2, 2018

(65) Prior Publication Data

US 2019/0270611 A1 Sep. 5, 2019

(51) Int. Cl.

| | |
|---|---|
| ***B66B 1/34*** | (2006.01) |
| ***B66B 3/02*** | (2006.01) |
| ***B66B 5/00*** | (2006.01) |

(52) U.S. Cl.

CPC ..... *B66B 5/0018* (2013.01); *B66B 1/3461* (2013.01); *B66B 1/3492* (2013.01); *B66B 3/02* (2013.01)

(58) Field of Classification Search

USPC ..... 187/390

See application file for complete search history.

(56) References Cited

U.S. PATENT DOCUMENTS

| | | | | |
|---|---|---|---|---|
| 4,555,724 | A | 11/1985 | Enriquez | |
| 5,258,586 | A | 11/1993 | Suzuki et al. | |
| 6,115,482 | A | 9/2000 | Sears et al. | |
| 6,341,668 | B1 | 1/2002 | Fayette et al. | |
| 6,386,325 | B1 | 5/2002 | Fujita | |
| 8,020,672 | B2 | 9/2011 | Lin et al. | |
| 8,711,188 | B2 | 4/2014 | Kurzweil et al. | |
| 9,033,114 | B2 * | 5/2015 | Mizon | B66B 1/00 187/394 |
| 9,367,766 | B2 | 6/2016 | Wang et al. | |
| 9,785,867 | B2 | 10/2017 | Hamada et al. | |
| 2015/0068850 | A1 * | 3/2015 | Mattsson | B66B 1/3492 187/392 |

(Continued)

FOREIGN PATENT DOCUMENTS

| | | | |
|---|---|---|---|
| KR | 20110032591 | A | 3/2011 |
| WO | 2008065520 | A2 | 6/2008 |

OTHER PUBLICATIONS

Klingbeil et al.; Automonous Operation of Novel Elevators for Robot Navigation, IEEE International Conference on Robotics and automation (ICRA), 2010.

(Continued)

*Primary Examiner* — Christopher Uhlir

(74) *Attorney, Agent, or Firm* — Bachman & LaPointe, P.C.

(57) ABSTRACT

A method for determining an elevator landing table from within an elevator car includes obtaining landing index information from a position indicator of an elevator with a landing identification system mounted within the elevator; communicating the landing index information from the position indicator via the landing identification system; and associating the landing index information to a building landing reference to determine a position of the elevator car.

14 Claims, 6 Drawing Sheets

(56) References Cited

U.S. PATENT DOCUMENTS

| | | | | |
|---|---|---|---|---|
| 2015/0314985 | A1* | 11/2015 | Schoenauer | G01D 5/12 187/394 |
| 2016/0311646 | A1 | 10/2016 | Bryant et al. | |
| 2017/0349400 | A1 | 12/2017 | Bitzi | |
| 2019/0062105 | A1* | 2/2019 | Saarela | B66B 5/0025 |

OTHER PUBLICATIONS

Jain, et al., Implementing Multi-Floor Intelligence Within a Moving Elevator, Mar. 29, 2016.

* cited by examiner

LANDING IDENTIFICATION SYSTEM TO DETERMINE A BUILDING LANDING REFERENCE FOR AN ELEVATOR

BACKGROUND

The present disclosure relates to a passenger conveyance and, more particularly, to determining a landing at which the elevator car is presently located.

In performing elevator maintenance, it may be desirable for the elevator maintenance provider to recognize the current landing floor of the elevator. This information may be used for various purposes including determining the location of the elevator during shutdowns or trapped passenger events, linking sensor data to elevator position, or automatically determining the building landing numbers for the particular elevator. Conventional determination of elevator landings on older elevator systems typically requires installation of sensors at every landing or connecting into the existing elevator control system.

SUMMARY

A method for determining an elevator landing table from within an elevator car, the method according to one disclosed non-limiting embodiment of the present disclosure includes obtaining landing index information from a position indicator of an elevator with a landing identification system mounted within the elevator; communicating the landing index information from the position indicator via the landing identification system; and associating the landing index information to a building landing reference to determine a position of the elevator car.

A further embodiment of any of the foregoing embodiments of the present disclosure includes identifying the landing index information displayed on the position indicator with the landing identification system as the elevator moves within a hoistway.

A further embodiment of any of the foregoing embodiments of the present disclosure includes identifying the landing index information displayed on the position indicator with at least one of a remote monitoring system, an elevator controller, and a service tool as the elevator moves within a hoistway.

A further embodiment of any of the foregoing embodiments of the present disclosure includes determining the position of the elevator car with respect to each of a multiple of building floors from the building landing reference to determine a landing table.

A further embodiment of any of the foregoing embodiments of the present disclosure includes determining the landing table from the building landing reference and the landing index information at the remote monitoring system.

A further embodiment of any of the foregoing embodiments of the present disclosure includes, wherein associating the landing index information to a building landing reference is performed on demand of the remote monitoring system.

A further embodiment of any of the foregoing embodiments of the present disclosure includes using an image recognition algorithm of the remote monitoring system.

A landing identification system for an elevator according to one disclosed non-limiting embodiment of the present disclosure includes a sensor operable to view a position indicator within an elevator car; a processor in communication with the sensor; and a communication device in communication with the processor to associate a landing index information from the position indicator to a building landing reference.

A further embodiment of any of the foregoing embodiments of the present disclosure includes that the landing index information is alphanumeric.

A further embodiment of any of the foregoing embodiments of the present disclosure includes that the landing index information is a series of lights.

A further embodiment of any of the foregoing embodiments of the present disclosure includes that the landing index information is a dial.

A further embodiment of any of the foregoing embodiments of the present disclosure includes that the processor is operable to identify the landing index information displayed on the position indicator via optical character recognition as the elevator car moves within a hoistway.

A further embodiment of any of the foregoing embodiments of the present disclosure includes that the remote monitoring system is operable to determine a landing table operable to associate the landing index information to a building landing reference via optical character recognition.

A further embodiment of any of the foregoing embodiments of the present disclosure includes that the remote monitoring system is operable to identify a landing index information displayed on the position indicator via optical character recognition as the elevator car moves within a hoist way.

A further embodiment of any of the foregoing embodiments of the present disclosure includes that the remote monitoring system is operable to determine a landing table operable to associate the landing index information to a building landing reference via optical character recognition.

A further embodiment of any of the foregoing embodiments of the present disclosure includes that the landing identification system is mounted within the elevator.

A further embodiment of any of the foregoing embodiments of the present disclosure includes remote monitoring system is operable to determine a landing table.

A further embodiment of any of the foregoing embodiments of the present disclosure includes that the building landing reference is a numerical sequence.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
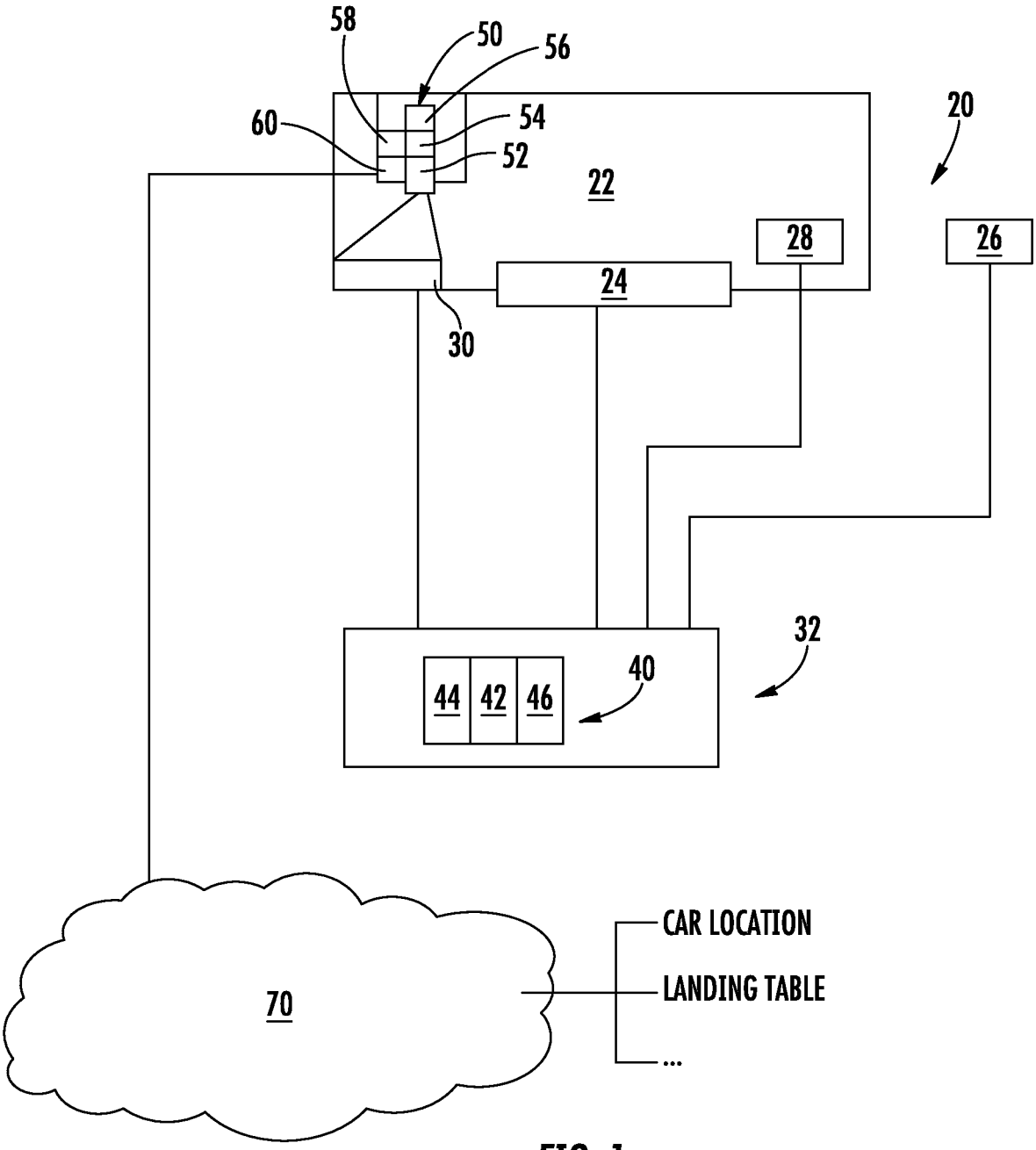
FIG. 1 is a schematic view of an elevator system according to one disclosed non-limiting embodiment.

FIG. 1 schematically illustrates a passenger conveyance system 20 such as an elevator system. The system 20 can include an elevator car 22 with an elevator door 24, a fixture 26 external to the elevator car 22, a car-operating panel (COP) 28 internal to the elevator car 22 and a position indicator 30 internal to the elevator car 22. The car position indicator 30 may be integrated into the car-operating panel (COP) 28 or may be a separate display above or adjacent to the elevator door 24 to indicate the current building landing number of the elevator car. The elevator landing is a portion of a floor, balcony, or platform adjacent to an elevator hoistway which is used to receive and discharge passengers or freight.

The car position indicator 30 may be of various forms such as lights, dials, CRT, dot matrix, segmented displays, ELDs, LCDs, and other displays which indicate to the passengers in the elevator car 22 the location of the elevator car 22 with alphanumeric or other indicators with respect to each landing within the building. Although particular systems are separately defined, each or any of the systems may be otherwise combined or separated via hardware and/or software.

Various passenger conveyance systems 20 can utilize a passenger-initiated input to request service. The fixture 26 may, for example, include a control panel within a landing area. Input from the fixture 26 may include a push button, e.g., up, down, or desired destination, to request elevator service. The passenger-initiated input is operable to notify the control system 32 that a passenger requires elevator service. In response, the control system 32 will dispatch the elevator car 22 to the appropriate floor, communicate a car assignment to the passenger, and provide directions to the passengers to the appropriate elevator in a multi-elevator system. Once inside the elevator car 22, the passenger may also push a button on the car-operating panel (COP) 28 to designate or change the desired destination.

The control system 32 can include a control module 40 with a processor 42, a memory 44, and an interface 46. The control module 40 can include a portion of a central control, a stand-alone unit, or other system such as a cloud-based system. The processor 42 can include any type of microprocessor having desired performance characteristic. The memory 44 may include any type of computer readable medium that stores the data and control processes disclosed herein. That is, the memory 44 is an example computer storage media that can have embodied thereon computer-useable instructions such as a process that, when executed, can perform a desired method. The interface 46 of the control module 40 can facilitate communication between the control module 40 and other systems which are a part of this embodiment, or other systems external to the elevator system, e.g. building management systems.

Figure 2:
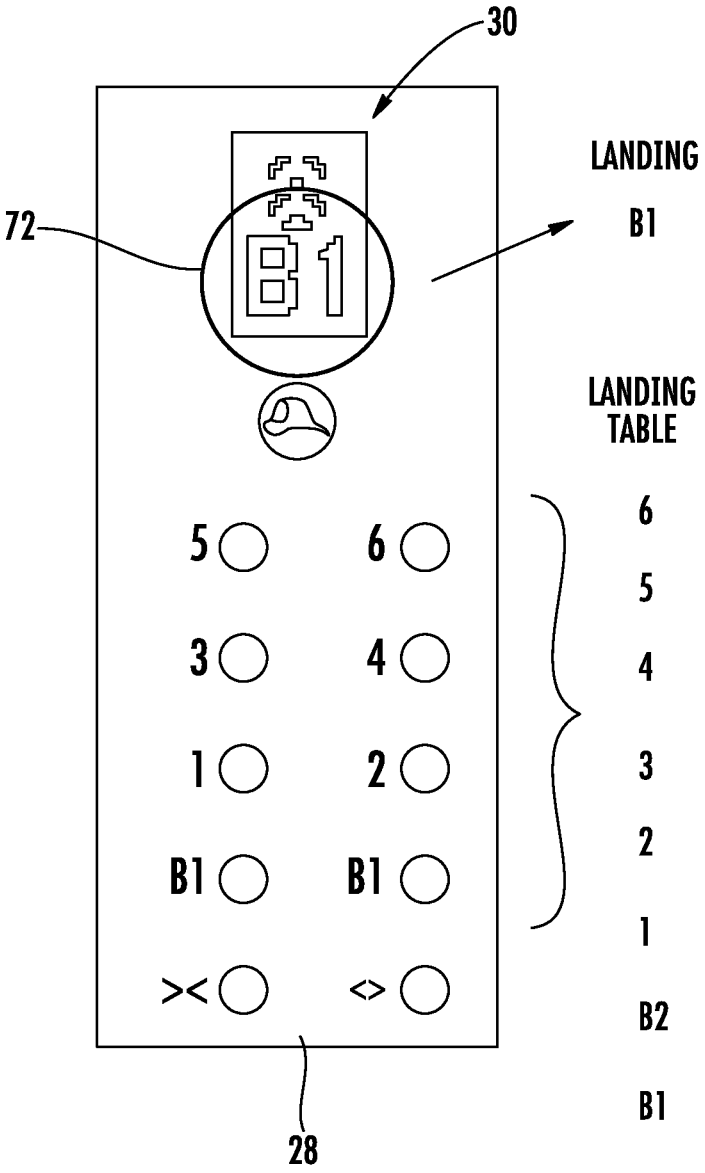
FIG. 2 is a representation of one example of a position indicator within an elevator car.
Figure 3:
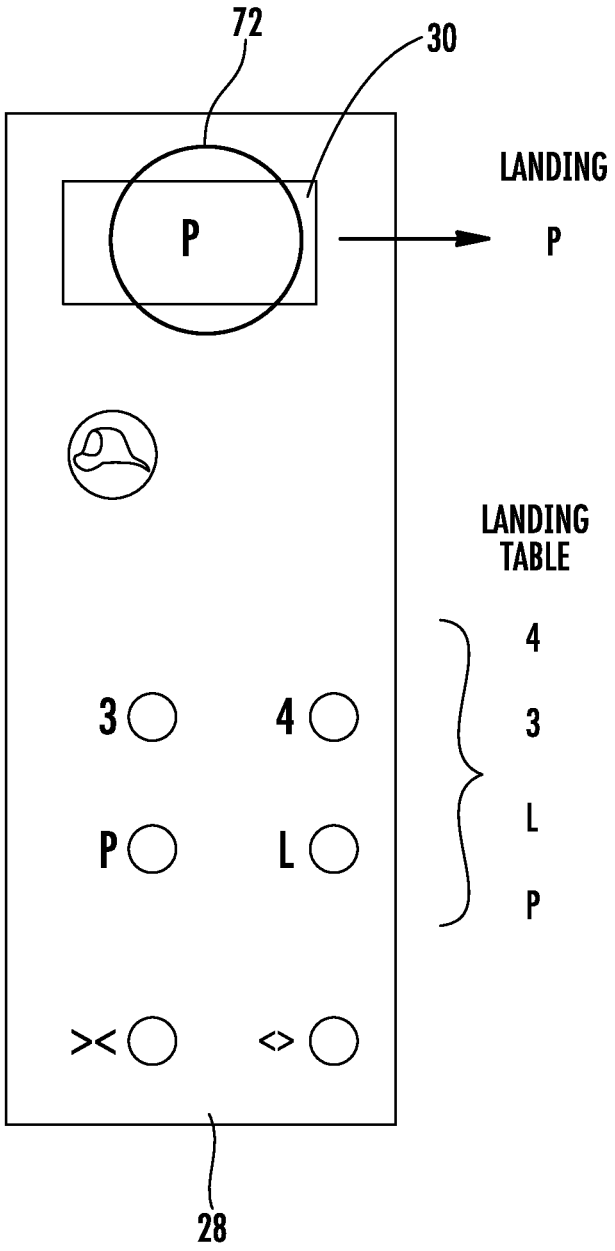
FIG. 3 is a representation of another example of a position indicator within an elevator car.
Figure 4:
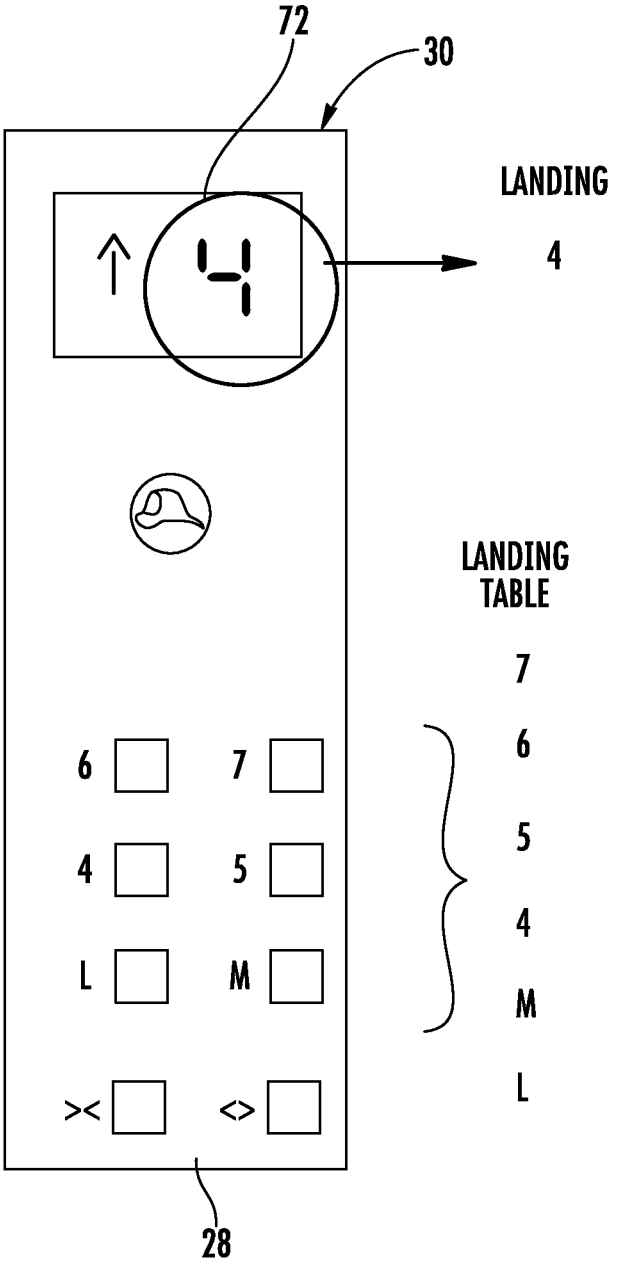
FIG. 4 is a representation of another example of a position indicator within an elevator car.
Figure 5:
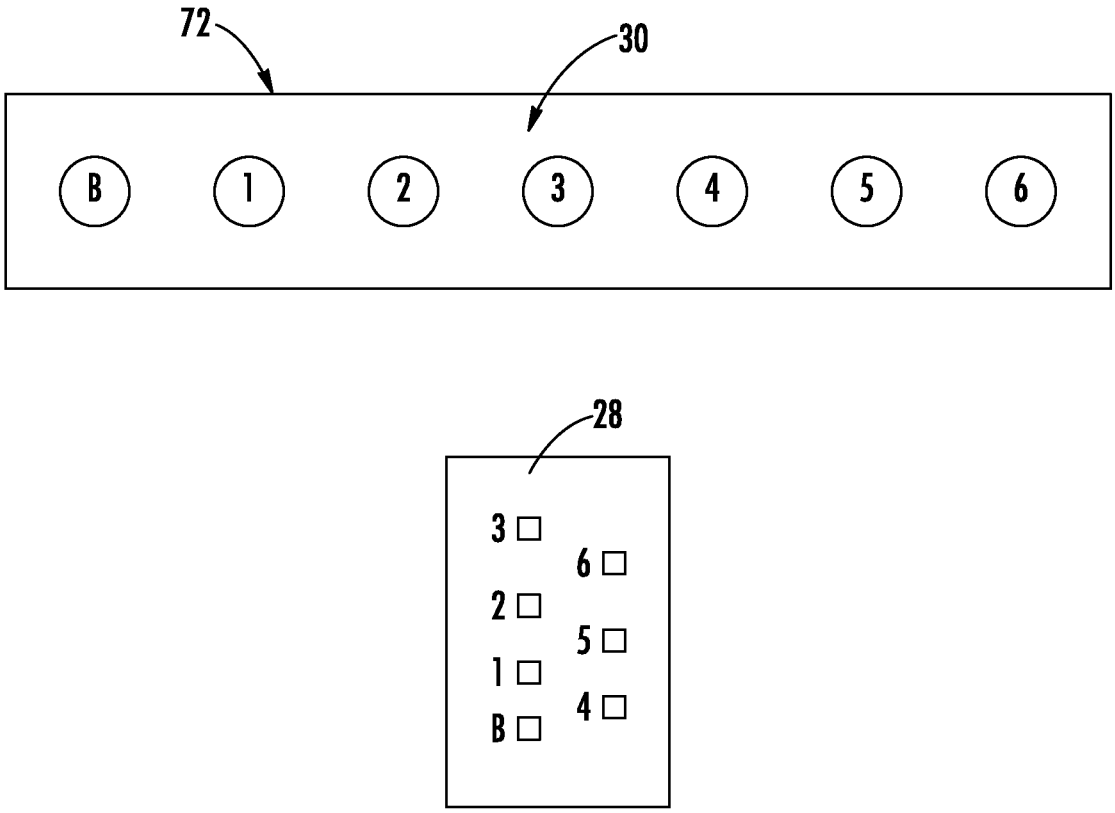
FIG. 5 is a representation of another example of a position indicator within an elevator car.

A landing identification system 50 includes a sensor 52, a processor 54, a memory 56, an interface 58, a communication device 60. In one example, the sensor 52, through the processor 54, is operable to identify the landing displayed by the car position indicator 30 (shown, for example, in FIG. 2, 3, 4, 5, which show various representations of a position indicator within an elevator car). FIG. 2 illustrates an alphanumeric display, FIG. 3 illustrates an alphanumeric light display, FIG. 4 illustrates a digital display, and FIG. 5 illustrates multiple illuminating lights. The landing identification system 50 may be a self-contained unit that is mounted within the car elevator car 22 with a view of the car position indicator 30.

The sensor 52 can be operable in the optical, electromagnetic or acoustic spectrum, or may aggregate multiple distinct sensor inputs into a single contact, e.g. to improve sensor performance. In embodiments, one or more sensors 52 can be arranged with a field of view (FOV) or other spatially or symbolically bounded region of the position indicator 30. For example, an imaging sensor such as a CCD or similar camera (e.g., a USB camera) may be used as the sensor 52.

The processor 54 communicates with the sensor 52 and controls capturing of data, such as images or vide, from the sensor 52 and processes them through image recognition algorithms such as, for example, pattern matching, pattern recognition, supervised learning, unsupervised learning, data mining, knowledge discovery in databases (KDD) and other computer vision techniques. The processor 54 will use the image recognition algorithms to pinpoint the location of the position indicator and the landing characters, and convert the image to a current landing character string or number.

The processor 54 then utilizes the communication device 60 to communicate with a remote monitoring system 70 such as an elevator maintenance cloud application. In an alternate embodiment, this can be performed locally by the elevator controller or a mechanic's service tool. The communication device 60 may be a Wi-Fi transceiver communicating with a Wi-Fi router in turn hardwired to an internet connection such as via a modem to communicate with one or more cloud servers. The remote monitoring system 70 may be a cloud based system or otherwise be an off-site system. In some embodiments, the image recognition algorithms may alternately be implemented in the remote monitoring system 70. The image recognition algorithms identify that which is displayed by the position indicator 30. For example, the image recognition algorithms may search within a predefined field of view 72 (FIG. 2) such as a square, rectangle, circle, etc., that contains a specified number or characters to identify a pattern of characters within a predetermined area on the car position indicator 30. Alternatively, the image recognition algorithms can search for a changing set of characters within the predefined field of view 72. By recognizing a set of characters that change over time, the image recognition algorithms differentiate between fixed numbers (e.g., car number, button number, etc.) on the car-operating panel (COP) 28 and the position indicator 30 when integrated into a single panel. The image recognition algorithms are also applicable to older car position indicators that may have a lamp or light for every landing (FIG. 5), and the landing engraved or marked next to or on the lamp. For example, one light illuminates at a time to indicate the current landing such that the image recognition algorithm would search for a pattern of lights illuminating one at a time with a fixed number or letter next to, or on, each lamp.

Figure 6:
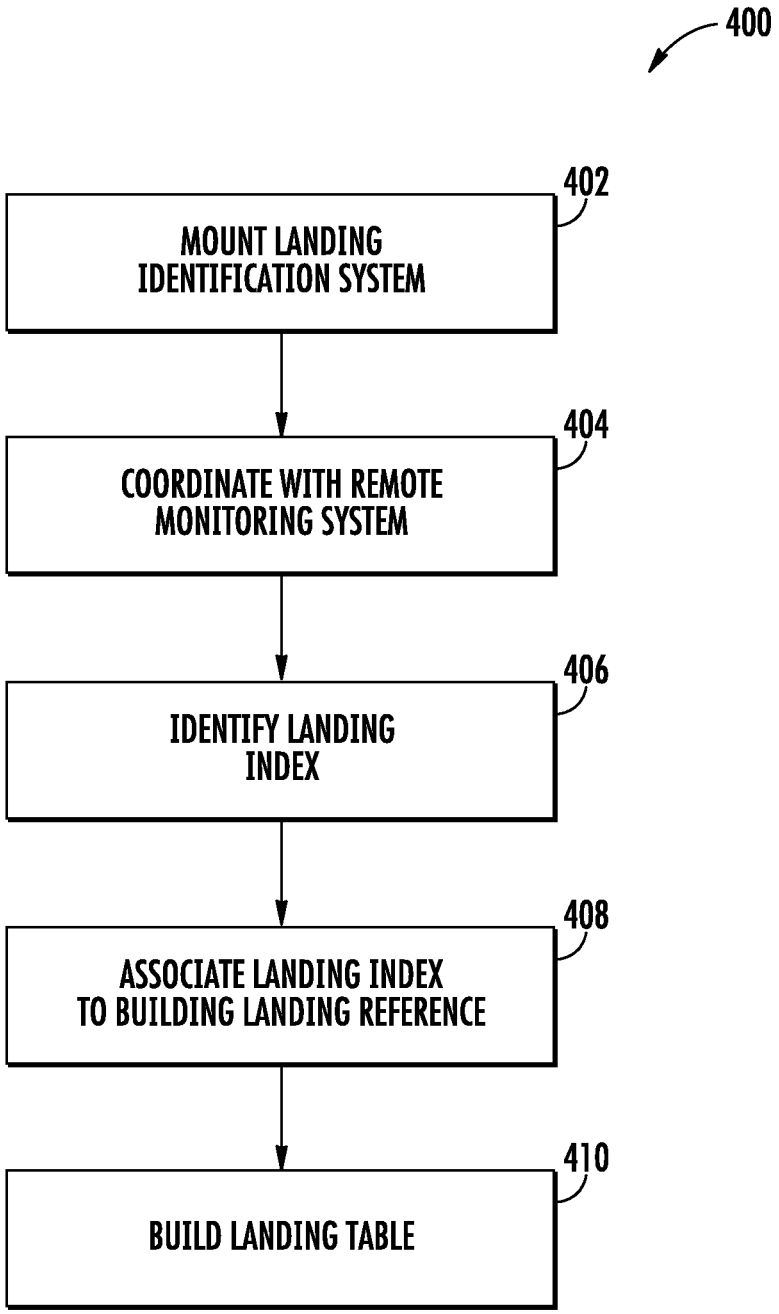
FIG. 6 is a block diagram for operation of the landing identification system according one disclosed non-limiting embodiment.

With reference to FIG. 6, one non-limiting embodiment of a method 400 for determining elevator landing is disclosed. Initially, the landing identification system 50 is mounted (402) within the elevator car 22 to have a view of the position indicator 30. The landing identification system 50 may be self-contained and have an internal power source. Alternatively, the landing identification system 50 needs only a power connection to the elevator car 22 such as a connection through the lights of the elevator car 22.

Next, the landing index information displayed on the position indicator 30 from the landing identification system 50 is communicated (404) to the remote monitoring system 70. In one embodiment, the image recognition is performed in the landing identification system 50 and the landing index information is communicated to the remote monitoring system 70. Alternatively, the predefined field of view 72 is communicated to the remote monitoring system 70 and the image recognition is performed at the remote monitoring system 70.

Next, the landing index information displayed on the position indicator 30 is identified (406) with the landing identification system 50 as the elevator car 22 moves within a hoistway.

The remote monitoring system then associates (408) the landing index information (e.g., elevator opening or stop) that is displayed to the passenger (e.g., P2, P1, L, 2, 3) to the building landing reference that is used by the passenger conveyance system 20 (e.g., 1, 2, 3, 4, 5). In this example, the 3rd landing from the bottom of the building is "L." The building landing table can then be used to determine the total number of landings the elevator serves and car direction as the current landing changes. The building landing reference is determined with respect to the landing index information (e.g., elevator opening or stop) that is displayed to the passenger on the position indicator which is not typically the building landing reference as various possible labels exist for the ground floor (L, G, 1), unexpected labels often appear (R, S), and special cases such as the 13th floor being missing in some buildings have to be taken into account. This allows remote determination of elevator location with respect to the building landing reference in the case of elevator shutdown or trapped passenger event as well as facilitates repair and maintenance. The landing index information displayed may also be used for linking sensor data to the actual elevator location when the sensor data was sampled. The data collected can also be used to create usage data reports or to record building traffic patterns.

The current landing index information displayed on the position indicator 30 can also be communicated to the remote monitoring system periodically or on demand for use by the elevator maintenance provider. For example, the current landing index information displayed on the position indicator 30 can be sampled at a frequency of every 500 milliseconds or, other alternatively another frequency, including continuously. The landing identification system 50 can also automatically learn the building landing reference by which the elevator car travels. By sampling the landing index information displayed on the position indicator 30, the landing identification system 50 can learn the landing numbers in sequence as the elevator travels up and down the hoistway. This data may also be used to automatically build a table (410) of the building landing numbers that the elevator passes by to be used by the elevator maintenance provider. Knowledge of the landing table allows determination of the direction of elevator car travel when the car landing position is changing. This data can also be sent to the remote monitoring system.

The landing identification system 50 automatically determines the current elevator landing for any type of elevator with a position indicator without any existing elevator components to build an elevator landing table for the unit. The building landing table lists building landing index information. The building landing index information is alpha numeric and the landing table will also provide a numeric sequential landing number associated with every building landing index information. By tracking the landing sequence, the direction of travel can be determined. For example, a 1, 2, 3, sequence from the building landing reference is an up direction run as compared to an unknown landing index information sequence.

The elements disclosed and depicted herein, including in flow charts and block diagrams throughout the FIGS., imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, dynamically loaded or updated modules, or any combination of these, and all such implementations may be within the scope of the present disclosure.

It should be appreciated that like reference numerals identify corresponding or similar elements throughout the several drawings. It should also be appreciated that although a particular component arrangement is disclosed in the illustrated embodiment, other arrangements will benefit herefrom.

Although the different non-limiting embodiments have specific illustrated components, the embodiments are not limited to those particular combinations. It is possible to use some of the components or features from any of the non-limiting embodiments in combination with features or components from any of the other non-limiting embodiments.

Although particular step sequences are shown, disclosed, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason, the appended claims should be studied to determine true scope and content.

What is claimed is:

1. A method for determining an elevator landing table from within an elevator car, the method comprising:

obtaining a landing index information from a position indicator of an elevator with a landing identification system mounted within the elevator;

communicating the landing index information from the position indicator via the landing identification system;

associating the landing index information to a building landing reference to determine a position of the elevator car; and identifying the landing index information displayed on the position indicator with the landing identification system as the elevator moves within a hoistway.

2. The method as recited in claim 1, further comprising determining the position of the elevator car with respect to each of a multiple of building floors from the building landing reference to determine a landing table.

3. The method as recited in claim 2, further comprising determining the landing table from the building landing reference and the landing index information at a remote monitoring system.

4. The method as recited in claim 3, wherein associating the landing index information to a building landing reference is performed on demand of the remote monitoring system.

5. The method as recited in claim 3, wherein identifying the landing index information displayed on the position indicator comprises using an image recognition algorithm of the remote monitoring system.

6. A method for determining an elevator landing table from within an elevator car, the method comprising:

obtaining a landing index information from a position indicator of an elevator with a landing identification system mounted within the elevator;

communicating the landing index information from the position indicator via the landing identification system; and associating the landing index information to a building landing reference to determine a position of the elevator car; and identifying the landing index information displayed on the position indicator with at least one of a remote monitoring system, an elevator controller, and a service tool as the elevator moves within a hoistway.

7. A landing identification system for an elevator, comprising:

a sensor operable to view a position indicator within an elevator car;

a processor in communication with the sensor;

a communication device in communication with the processor to associate a landing index information from the position indicator to a building landing reference; and wherein the processor is operable to identify the landing index information displayed on the position indicator via optical character recognition as the elevator car moves within a hoistway.

8. The system as recited in claim 2, wherein the landing index information is alphanumeric.

9. The system as recited in claim 2, wherein a remote monitoring system is operable to determine a landing table operable to associate the landing index information to a building landing reference via optical character recognition.

10. The system as recited in claim 7, wherein the landing identification system is mounted within the elevator.

11. The system as recited in claim 7, further comprising a remote monitoring system operable to determine a landing table.

12. The system as recited in claim 7, wherein the building landing reference is a numerical sequence.

13. A landing identification system for an elevator, comprising:

a sensor operable to view a position indicator within an elevator car;

a processor in communication with the sensor; and a communication device in communication with the processor to associate a landing index information from the position indicator to a building landing reference; and a remote monitoring system operable to identify the landing index information displayed on the position indicator via optical character recognition as the elevator car moves within a hoist way.

14. The system as recited in claim 13, wherein the remote monitoring system is operable to determine a landing table operable to associate the landing index information to a building landing reference via optical character recognition.

* * * * *